US011220881B2

(12) United States Patent
Zachry et al.

(10) Patent No.: US 11,220,881 B2
(45) Date of Patent: Jan. 11, 2022

(54) SEALING TUBING ANCHOR CATCHER

(71) Applicant: Lufkin Lift Solutions LLC, Missouri City, TX (US)

(72) Inventors: Brandon Zachry, Crossroads, TX (US); Christopher Valenzuela, Midland, TX (US); Michael Thompson, Midland, TX (US)

(73) Assignee: Lufkin Lift Solutions LLC, Missouri City, TX (US)

( * ) Notice: Subject to any disclaimer, the term of this patent is extended or adjusted under 35 U.S.C. 154(b) by 0 days.

(21) Appl. No.: 16/846,002

(22) Filed: Apr. 10, 2020

(65) Prior Publication Data

US 2020/0325750 A1 Oct. 15, 2020

Related U.S. Application Data

(60) Provisional application No. 62/833,200, filed on Apr. 12, 2019.

(51) Int. Cl.

| | |
|---|---|
| ***E21B 33/129*** | (2006.01) |
| ***E21B 33/124*** | (2006.01) |
| ***E21B 43/12*** | (2006.01) |

(52) U.S. Cl.

CPC ..... *E21B 33/1293* (2013.01); *E21B 33/124* (2013.01); *E21B 43/122* (2013.01); *E21B 2200/01* (2020.05)

(58) Field of Classification Search

CPC .. E21B 33/1293; E21B 33/124; E21B 43/122; E21B 2200/01; E21B 33/129

See application file for complete search history.

(56) References Cited

U.S. PATENT DOCUMENTS 3,509,940 A * 5/1970 Young ..... E21B 33/1265 166/121
3,520,361 A * 7/1970 Lewis ..... E21B 33/1292 166/134
3,783,941 A * 1/1974 Kisling, III ..... E21B 33/1291 166/217
4,702,313 A * 10/1987 Greenlee ..... E21B 23/01 166/216

OTHER PUBLICATIONS

Cast the Anchor, Jul. 26, 2018 (4 pages).

* cited by examiner

*Primary Examiner* — Taras P Bemko
(74) *Attorney, Agent, or Firm* — Dentons Cohen & Grigsby P.C.

(57) ABSTRACT

A production tool that can aid in the operation of a producing oil/gas well is provided. In use, the tool is connected to production tubing and disposed in a wellbore, for example, below a pump. The tool includes an anchoring body that anchors the production tubing to a casing lining the wellbore. The tool also includes one or more sealing elements that create a seal with the casing.

19 Claims, 5 Drawing Sheets

SEALING TUBING ANCHOR CATCHER

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/833,200, filed Apr. 12, 2019, the entirety of which is incorporated by reference herein and should be considered part of this specification.

BACKGROUND

Field

The present disclosure generally relates to downhole production tools for use in a well.

Description of the Related Art

Oil and gas wells utilize a borehole drilled into the earth and subsequently completed with equipment to facilitate production of desired fluids from a reservoir. Subterranean fluids, such as oil, gas, and water, are produced from the wellbore. In some cases, the fluid is produced to the surface naturally by downhole formation pressures. However, the fluid must often be artificially lifted from wellbores by the introduction of downhole equipment. Various types of artificial lift are available, including, for example, rod pumps, gas lift, and plunger lift. In a rod pump system, a beam and crank assembly is located at the surface of a well to provide power to a downhole pump assembly. The pump includes a plunger and valve assembly. A rod string, including sucker rods, connects the surface components to the pump. The beam and crank assembly creates reciprocating motion in the rod string, and the pump converts the reciprocating motion to vertical movement of the fluid being pumped. In a gas lift system, a compressor is located on the surface. The compressor pumps gas down the casing tubing annulus. The gas is then released into the production tubing via gas valves that are strategically placed throughout the production tubing. The gas that is introduced lightens the hydrostatic weight of the fluid in the production tubing, allowing the reservoir pressure to lift the fluid to surface. In a plunger lift system, a series of valves are placed on the wellhead at the surface. A plunger is introduced into the production tubing. The valves are opened and closed at intervals which allows the plunger to travel up and down vertically in the wellbore forcing the fluid to surface.

SUMMARY

In some configurations, a downhole component configured to be coupled to production tubing and disposed in a well in use includes a mandrel, and anchoring body, and one or more sealing elements. The anchoring body is disposed on the mandrel and configured to anchor the production tubing to a casing lining the well. The sealing elements are disposed on the mandrel and configured to create a seal with the casing. The downhole component can be used in a rod pump system, a gas lift system, a plunger lift system, or a naturally flowing well.

In some configurations, a method of preparing a well for production includes coupling a downhole component to production tubing. The downhole component includes a mandrel, an anchoring body, and one or more sealing elements. The anchoring body is disposed on the mandrel and configured to anchor the production tubing to a casing lining the well. The one or more sealing elements are disposed on the mandrel and configured to create a seal with the casing. The method further including lowering the downhole component into position in the well such that the one or more sealing elements form seals between the production tubing and the casing, and anchoring the anchoring body to the casing. The method can further include inserting a pump into the well above the downhole component for use in a rod pump system. Alternatively, the method can prepare a well for use of a gas lift system, a plunger lift system, or for production from a naturally flowing well.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
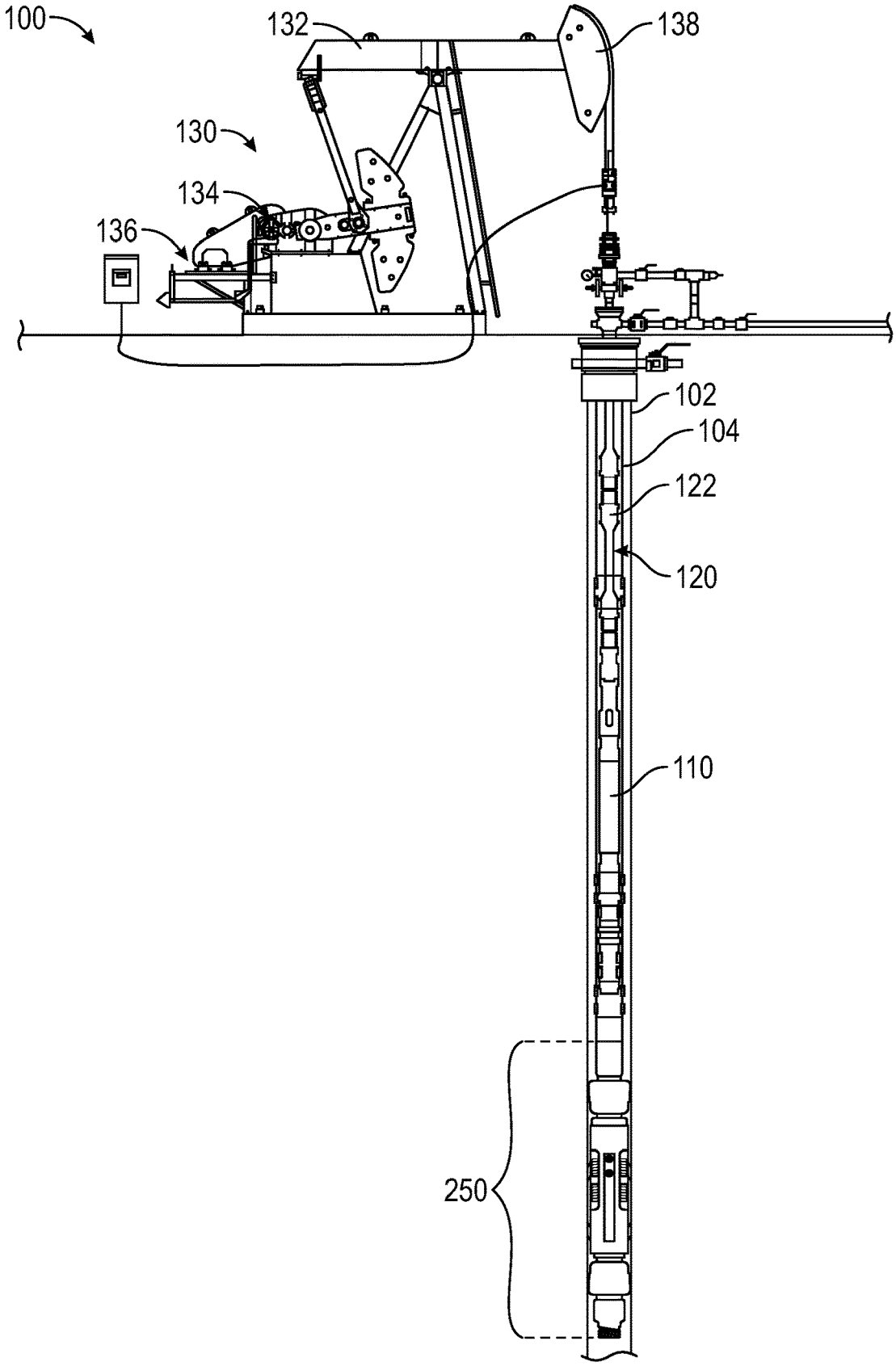
FIG. 1 illustrates an example of a rod pump system including an example embodiment of a sealing TAC according to the present disclosure.

FIG. 1 illustrates an example rod pump system 100. As shown, the rod pump system 100 includes a pump 110, a rod string 120, and a power assembly 130. The rod string 120 includes one or more sucker rods 122. The power assembly 130 includes a beam 132, a first end of which is operably coupled to a gearbox 134, which in turn is operably coupled to a motor 136. The rod string 120 is coupled to a head 138 at a second, opposite end of the beam 132. In use, the motor 136 drives the gear 134, which causes the beam 132 to rock back and forth, creating reciprocal motion of the rod string 120. The pump 110 includes a plunge and a valve assembly.

In use, the pump 110 is disposed downhole in a borehole lined with a well casing 102 as shown. The surface power assembly 130 is disposed at the surface of the well. The sucker rods 122 extend between and connect (e.g., physically and/or operatively connect) surface components of the system 100, such as the power assembly 130, and downhole components of the system 100, such as the pump 110. Production tubing 104 can be disposed in the borehole to convey pumped fluids discharged from the outlet of the pump 110 to the surface. The tubing 104 can be disposed around or surround the sucker rods 122 as shown. During operation, the power assembly 130 creates reciprocating motion in the rod string 120, and the pump 110 converts the reciprocating motion to vertical movement of the fluids to be pumped. Various production tools can be disposed downhole to enhance the efficiency and effectiveness of the rod pump system 100. The illustrated rod pump system 100 also includes a sealing tubing anchor catcher (sealing TAC) 250 according to the present disclosure, as described in greater detail herein.

Figure 4:
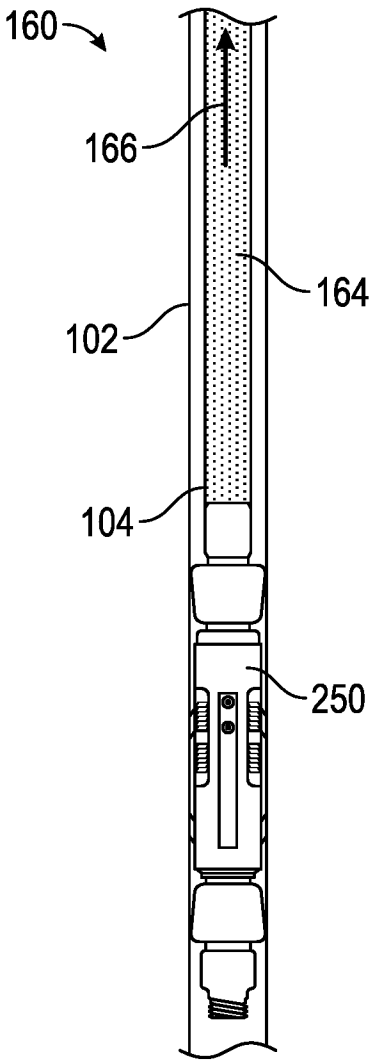
FIG. 4 illustrates an example of a free flowing well including an example embodiment of a sealing TAC according to the present disclosure.
Figure 3:
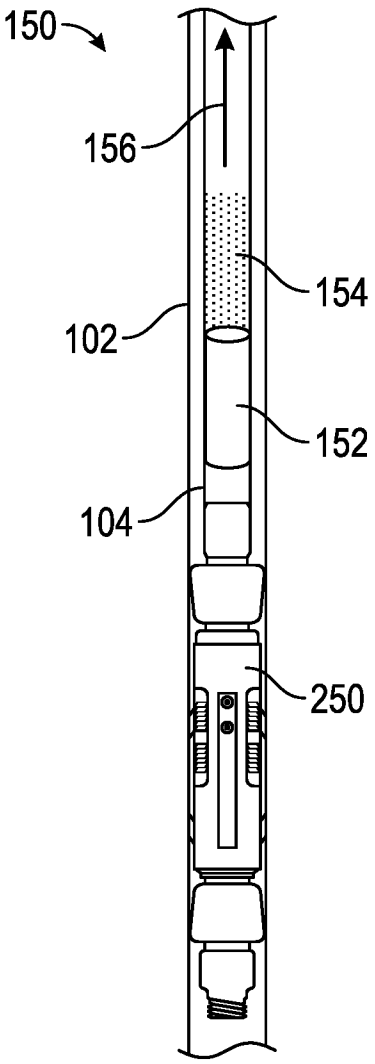
FIG. 3 illustrates an example of a plunger lift system including an example embodiment of a sealing TAC according to the present disclosure.
Figure 2:
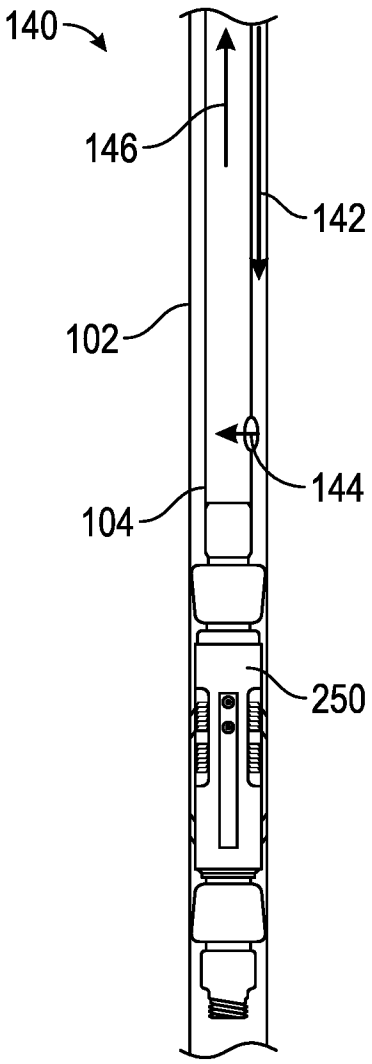
FIG. 2 illustrates a portion of an example of a gas lift system including an example embodiment of a sealing TAC according to the present disclosure.

FIG. 2 illustrates a downhole portion of an example gas lift system 140. The gas lift system 140 includes a compressor located at the well surface. In use, the compressor pumps gas down the annulus between the casing 102 and the tubing 104, as indicated by arrow 142. The gas is then released into the tubing 104 via one or more gas valves 144 that are strategically placed throughout the tubing 104. The gas lessens the hydrostatic weight of the fluid in the tubing 104, allowing the reservoir pressure to lift the fluid to the surface, as indicated by arrow 146. The gas lift system 140 can also include a sealing TAC 250 as shown. FIG. 3 illustrates a downhole portion of an example plunger lift system 150. In use, the well is shut-in, and a plunger 152 is dropped down the tubing 104. When the well is opened, the plunger 152 and a column of fluid 154 are lifted to the surface, as indicated by arrow 156. The plunger lift system 150 can also include a sealing TAC 250 as shown. FIG. 4 illustrates a downhole portion of a free or naturally flowing well, in which the formation pressure is sufficient to produce the fluid 164 to the surface, as indicated by arrow 166. A free or naturally flowing well can also include a sealing TAC 250 as shown.

Figure 5A:
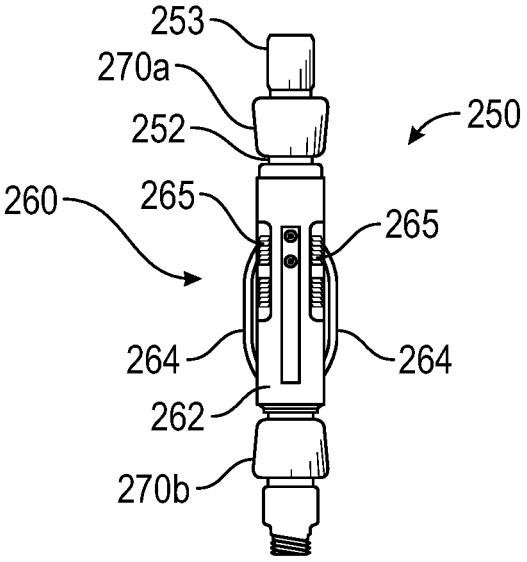
FIGS. 5A and 5B illustrate an example embodiment of a sealing TAC according to the present disclosure.
Figure 5B:
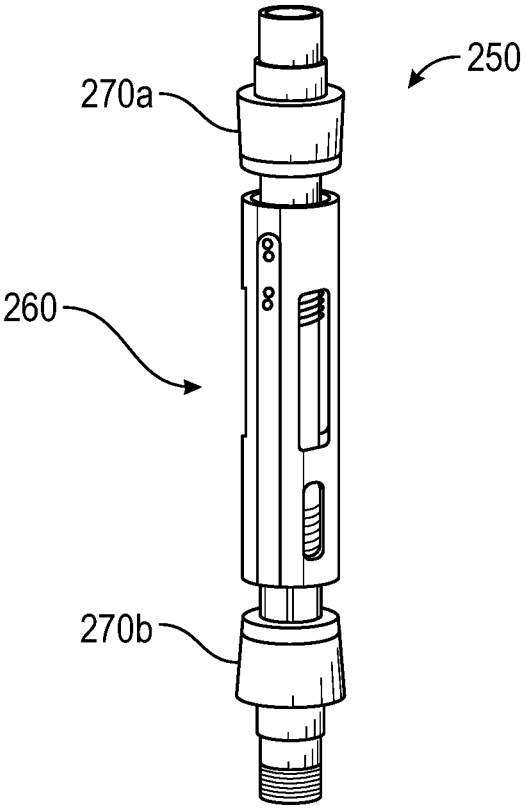

An example of a sealing tubing anchor catcher (sealing TAC) 250 according to the present disclosure is shown in FIGS. 5A-5B. The sealing TAC 250 can advantageously both anchor the production tubing 104 to the well casing 102 and create a seal with the casing 102, for example, between the tubing 104 and casing 102. By performing both of these functions, the sealing TAC 250 advantageously reduces the number of components that must be installed and maintained in a well. This can reduce the opportunities for operator errors and/or equipment malfunctions or failures. As shown, the sealing TAC 250 includes a mandrel 252, a connector 253 at an upper end of the mandrel 252, an anchoring body 260 disposed on, around, or along the mandrel 252, and one or more sealing elements 270 disposed on, around, or along the mandrel 252. In the illustrated configuration, the sealing TAC 250 includes two sealing elements 270*a*, 270*b*. The connector 253 is designed to couple to the tubing 104 and/or other components of a pump system.

The anchoring body 260 includes a main body 262, one or more slips 265, and one or more drag springs 264 projecting radially outwardly from the main body 262. For use, the tubing 104 is secured to the sealing TAC 250 (e.g., to the connector 253), and the sealing TAC 250 and tubing 104 are lowered into position in the well. The drag springs 264 contact the casing 102 to create friction and help hold the sealing TAC 250 in place during deployment. Once in position, the tubing 104 is rotated at the well surface. Rotation of the tubing 104 causes the slips 265 to deploy into engagement with the casing 102, thereby anchoring the sealing TAC 250, and therefore the tubing 104, to the casing 102.

The sealing elements 270 are designed and sized to seal against the well casing 102 in use. The sealing elements 270 can be made of or include an elastomeric material. As shown, the sealing elements 270 can have a hollow truncated cone shape. In other words, an outer surface of the sealing elements 270 can be tapered, and the sealing elements 270 have lumens therethrough to receive the mandrel 252. The sealing elements 270 can be disposed on the mandrel 252 in an upward-facing orientation, in which the top edge or surface of the sealing element 270 has a greater circumference than the lower edge or surface, or a downward-facing orientation, in which the bottom edge or surface has a greater circumference than the upper edge or surface.

The sealing elements 270 can be sized such that the diameter, circumference, or perimeter of the larger edge or surface is about the same or slightly greater than an inside diameter, circumference, or perimeter of the casing 102 such that the sealing elements 270 can form a seal with the interior surface of the casing 102. The sealing elements 270 are designed to be free spinning, or relatively free spinning, on the mandrel 252. In other words, the inner diameter, circumference, or perimeter of the lumen through the sealing elements 270 is about the same or slightly greater than an outer diameter, circumference, or perimeter of the mandrel 252. Such an arrangement allows for rotational setting of the slips 265 of the anchoring body 260 via rotation of the tubing 104 and mandrel 252 without interference by the sealing elements 270. This also allows the sealing element 270 to maintain their seal if the body 260 becomes unset (for example, due to movement of the tubing 104) and/or allows the body 260 to remain set if the sealing elements 270 become damaged.

This arrangement also allows the sealing elements 270 to seal against the casing 102 independently of setting the slips 265. The sealing elements 270 seal against the casing 102 via an interference fit upon introduction of the sealing elements 270 into the casing 102. Whereas rotational setting of the slip 265 may require a left-hand turn of the tubing, which acts against the right-hand tightening of the tubing 104 above the sealing TAC 250 and/or connection between the tubing 104 and sealing TAC 250, the sealing elements 270 do not require rotational setting, which can help reduce the risk of loosening tubing 104 connections. Automatic sealing of the sealing elements 270 with the casing 102, without requiring intervention or action by a user, can also help reduce the likelihood of human error in establishing the seals.

Figure 6C:
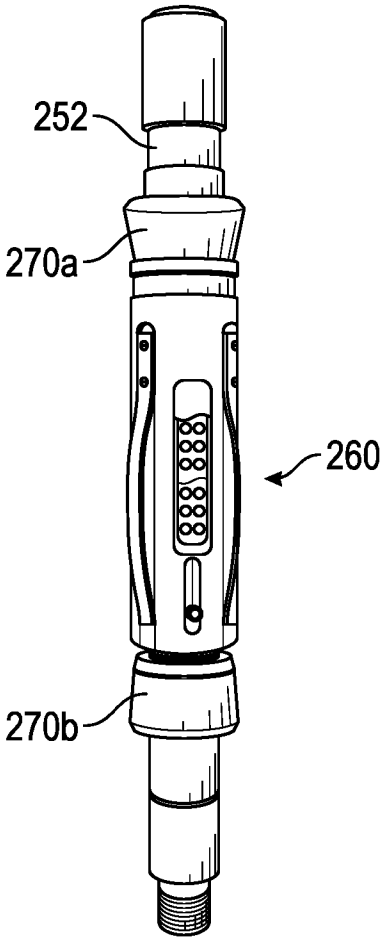
FIGS. 6A-6C illustrate an example embodiment of a sealing TAC according to the present disclosure.
Figure 6B:
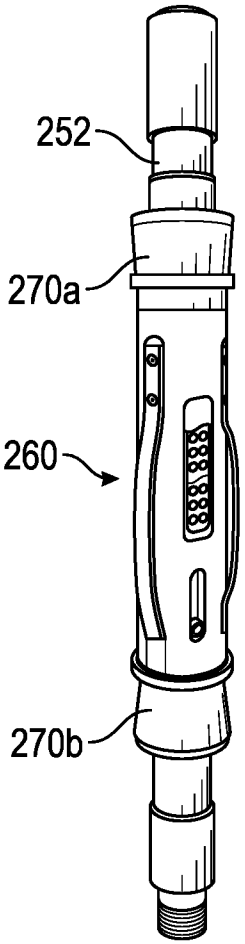
Figure 6A:
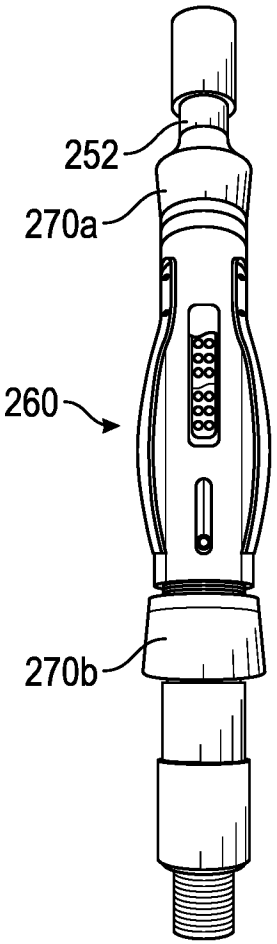

In the illustrated configuration, one sealing element 270 is disposed proximate, adjacent, or near each of the top or upper end and the bottom or lower end of the anchoring body 260. In other words, a first sealing element 270*a* is positioned above the anchoring body 260, and a second sealing element 270*b* is positioned below the anchoring body 260. In the illustrated configuration, the first sealing element 270*a* is upward-facing, and the second sealing element 270*b* is downward-facing. However, other arrangements and orientations of the sealing elements 270 are also possible. Zero, one, two, or more sealing elements 270 can be disposed above and below the anchoring body 260, and a different number of sealing elements 270 can be disposed above the anchoring body 260 compared to below the anchoring body 260. For example, a second sealing element 270*a*, 270*b* can be disposed above and/or below the anchoring body 260 to act as a back-up seal. The various sealing elements 270 can be either upward or downward facing. The sealing TAC 250 is therefore customizable by selecting the number, position, and orientation of sealing elements 270. The length of the mandrel 252 and position of the sealing elements 270 on the mandrel 252 can vary. For example, FIGS. 5A-5B illustrate an embodiment in which the sealing element 270*a* is slightly spaced from the sealing body 260, FIGS. 6A-6C illustrate a variation of the sealing TAC 250 having a relatively longer mandrel 252 (compared to the configuration of FIGS. 5A-5B) and in which the sealing element 270*a* is flush or substantially flush with the upper end of the sealing body 260.

Figure 7:
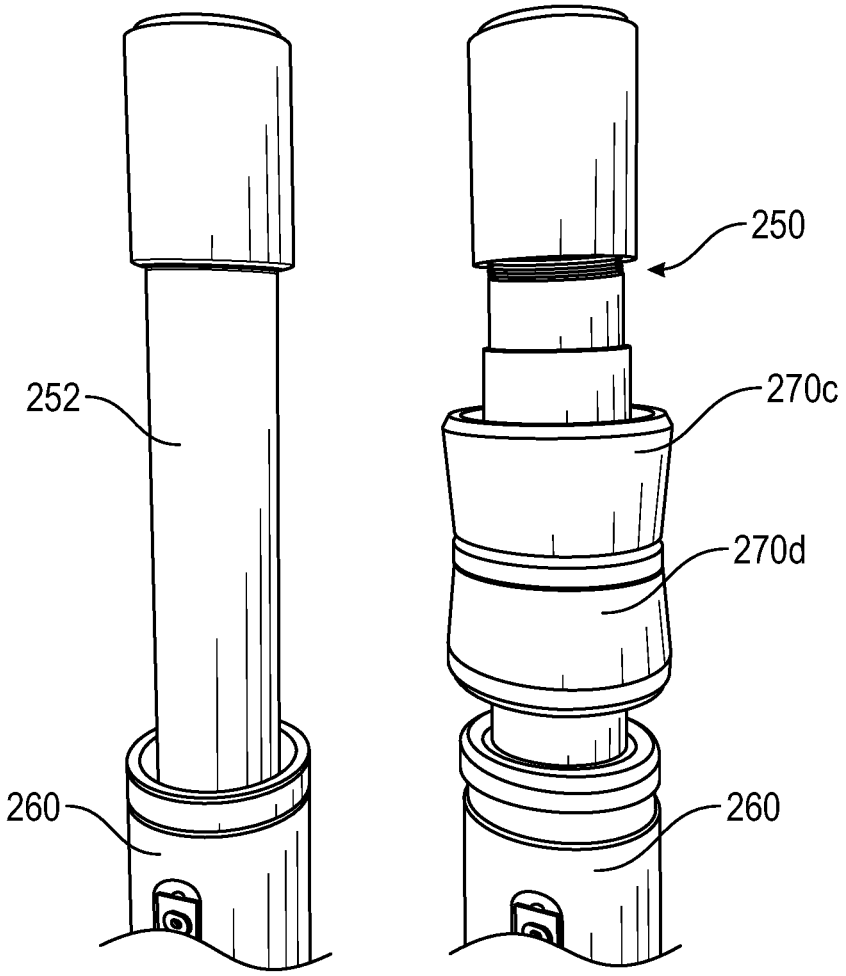
FIG. 7 illustrates another example embodiment of a sealing TAC according to the present disclosure.

FIG. 7 illustrates another example embodiment of a sealing TAC 250 on the right including two sealing elements 270 disposed above the anchoring body 260. In the configuration of FIG. 7, a first sealing element 270*c* is upward-facing and stacked on top of or disposed above a second, downward-facing sealing element 270*d*. To accommodate two sealing elements 270 above the anchoring body 260, the portion of the mandrel 252 above the anchoring body 260 is elongated, as shown on the left of FIG. 3 (which shows the sealing TAC 250 with the sealing elements 270 removed), compared to a conventional TAC, as shown in the background of FIG. 3. Additionally or alternatively, the portion of the mandrel 252 below the anchoring body 260 can be elongated to accommodate one, two, or more sealing elements 270 below the anchoring body 260.

The sealing TAC 250 is placed along and connected to the production tubing 104. The anchoring body 260 applies tension to the tubing 104 and anchors the tubing 104 to the casing 102 in use. The tubing 104 is secured to the sealing TAC 250, and the slips 265 contact or engage the well casing 102 to anchor the sealing TAC 250, and therefore the tubing 104, to the casing 102. In use, the anchoring body 260 can therefore help reduce movement of the tubing 104 caused by cyclical loading generated during operation of the pump system 200.

The sealing elements 270 create a seal with the casing 102, for example, between the tubing 104 and the casing 102. In use, the sealing elements 270 prevent, inhibit, or reduce the likelihood of solids (for example, solid particles suspended in the fluid being pumped) accumulating around the anchoring body 260. The sealing elements 270 can isolate the anchoring body 260 from solids and prevent, inhibit, or reduce the likelihood of the anchoring body 260 becoming compromised by solids. Without the sealing elements 270, accumulation of solids around the body 260 of the sealing TAC 250 could jam the mechanism and prevent or inhibit the slips 265 from engaging or disengaging during the installation or removal process. This accumulation of solids could also cause the slips 265 to disengage prematurely during operations. Additionally, as the seal between the sealing elements 270 and the casing 102 is created as soon as the sealing TAC 250 is inserted into the casing 102 (via an interference seal vs., for example, a mechanical seal that would require action by the user) the seal and/or sealing elements 270 can remove any solids in place during initial installation to help provide a solid anchoring point for the slips 265. Furthermore, the sealing elements 270 prevent or inhibit fluid from entering and/or accumulating in and/or around the body 260, which helps protect the body 260, e.g., the slips 265 and/or springs 264, from fluid corrosion and/or erosion. The sealing TAC 250 can therefore advantageously require less maintenance and fewer repairs in operation.

The sealing elements 270 can also provide a fluid seal and/or maintain pressure(s) above and/or below the anchoring body 260. As shown in FIG. 1, in use the sealing TAC 250 is disposed below the pump 110 in rod lift system 100. As shown in FIG. 2, the sealing TAC 250 is disposed below the valve(s) 144 of the gas lift system 140. As shown in FIG. 3, the sealing TAC 250 is disposed below the plunger 152 of the plunger lift system 150. The position of the sealing TAC 250 in the bottom hole assembly and seal(s) formed by the sealing element(s) 270 help force all or substantially all of the fluid produced into the tubing 104. For example, the lower sealing element 270*b* of FIGS. 5A-6C can help force all or substantially all of the fluid produced into the tubing 104. The upper sealing element 270*a* can hold fluid weight from above.

A method of using a sealing TAC 250 according to the present disclosure, or of preparing a well for operation or production, includes deploying the sealing TAC 250 on the tubing 104 or coupling the sealing TAC 250 to the tubing 104. The sealing TAC 250 is then run in hold to the desired depth. The sealing TAC 250 is lowered slowly to avoid damaging the sealing elements 270. Once at the desired depth, the method includes rotating the tubing 104 to the left (or counter-clockwise), for example, 5-8 turns, to deploy the slips 265. While holding the left hand torque, the tubing 104 is raised and lowered several times to firmly set the slips 265.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A downhole component configured to be coupled to production tubing and disposed in a well, the downhole component comprising:

a mandrel;

an anchoring body disposed on the mandrel and configured to anchor the production tubing to a casing lining the well; and one or more sealing elements rotatably disposed on the mandrel and configured to create a seal with the casing such that the production tubing can rotate within the sealing elements during anchoring of the anchoring body to the casing.

2. The downhole component of claim 1, the one or more sealing elements comprising two sealing elements.

3. The downhole component of claim 1, the one or more sealing elements comprising a first sealing element disposed on the mandrel above the anchoring body and a second sealing element disposed on the mandrel below the anchoring body.

4. The downhole component of claim 3, wherein the sealing elements have a truncated cone shape, the first sealing element oriented such that an upper surface of the first sealing element is larger than a lower surface of the first sealing element, and the second sealing element oriented such that a lower surface of the second sealing element is larger than an upper surface of the second sealing element.

5. The downhole component of claim 1, wherein the sealing elements have a truncated cone shape.

6. The downhole component of claim 5, comprising two sealing elements, and the two sealing elements oriented in opposite directions from each other.

7. The downhole component of claim 1, wherein the sealing elements are rotatably disposed on the mandrel.

8. The downhole component of claim 1, wherein the sealing elements comprise an elastomeric material.

9. The downhole component of claim 1, wherein the sealing elements are configured to seal with the casing via an interference seal.

10. The downhole component of claim 1, wherein the downhole component is configured to be disposed in a naturally flowing well.

11. An artificial lift system comprising the downhole component of claim 1, wherein the artificial lift system comprises a rod pump system, a gas lift system, or a plunger lift system.

12. A method of preparing a well for production the method comprising:

coupling a downhole component to production tubing, the downhole component comprising:

a mandrel;

an anchoring body disposed on the mandrel and configured to anchor the production tubing to a casing lining the well; and one or more sealing elements disposed on the mandrel and configured to create a seal with the casing;

lowering the downhole component into position in the well such that the one or more sealing elements form seals between the production tubing and the casing; and anchoring the anchoring body to the casing, wherein the sealing elements are rotatably disposed on the mandrel such that the production tubing can rotate within the sealing elements during anchoring of the anchoring body to the casing.

13. The method of claim 12, wherein anchoring the anchoring body to the casing comprises deploying slips of the anchoring body into engagement with the casing.

14. The method of claim 12, wherein anchoring the anchoring body to the casing comprises rotating the production tubing.

15. The method of claim 12, wherein the sealing elements create the seal with the casing via an interference seal.

16. The method of claim 12, further comprising inserting a pump into the well above the downhole component.

17. The method of claim 12, wherein the downhole component is configured for use in a rod pump system, gas lift system, plunger lift system, or naturally flowing well.

18. The method of claim 12, wherein, during production, the downhole component is configured to direct all fluid produced into the production tubing.

19. A method of preparing a well for production, the method comprising:

coupling a downhole component to production tubing, the downhole component comprising:

a mandrel;

an anchoring body disposed on the mandrel and configured to anchor the production tubing to a casing lining the well; and one or more sealing elements disposed on the mandrel and configured to create a seal with the casing;

lowering the downhole component into position in the well such that the one or more sealing elements form seals between the production tubing and the casing; and anchoring the anchoring body to the casing, wherein the sealing elements create the seal with the casing automatically without user intervention.

* * * * *